US005334004A

United States Patent [19]

Lefevre et al.

[11] Patent Number: 5,334,004

[45] Date of Patent: Aug. 2, 1994

[54] COMPRESSOR OR TURBINE TYPE ROTARY MACHINE FOR COMPRESSING OR EXPANDING A DANGEROUS GAS

[75] Inventors: Paul Lefevre; Alain Verneau, both of Maurepas, France

[73] Assignee: Bertin & Cie, Plaisir, France

[21] Appl. No.: 834,681

[22] Filed: Feb. 11, 1992

[30] Foreign Application Priority Data

Feb. 12, 1991 [FR] France ..... 9101579

[51] Int. Cl.[5] ..... F04B 17/00

[52] U.S. Cl. ..... 417/420; 417/423.13; 417/423.8; 415/112; 415/113; 415/168.2; 415/231; 277/3; 277/15; 277/22; 277/27; 277/71

[58] Field of Search ..... 417/420, 423.12, 423.13, 417/423.8; 415/168.1, 168.2, 110, 111, 112, 113, 170.1, 174.2, 231; 277/1, 3, 15, 22, 27, 70, 71

[56] References Cited

U.S. PATENT DOCUMENTS

| | | | |
|---|---|---|---|
| 2,457,880 | 1/1949 | Edwards . | |
| 2,965,398 | 12/1960 | Keller et al. | 415/112 |
| 3,477,729 | 11/1969 | Hershey | 277/1 |
| 3,508,758 | 4/1970 | Strub | 277/15 |
| 3,539,270 | 11/1970 | Derrickson . | |
| 3,645,643 | 2/1972 | King, III et al. | 415/111 |
| 3,831,381 | 8/1974 | Swearingen . | |
| 3,919,854 | 11/1975 | Denis | 277/15 |
| 3,949,996 | 4/1976 | Inoue et al. | 277/15 |
| 4,209,282 | 6/1980 | Eberhardt | 415/231 |
| 4,722,663 | 2/1988 | Swearingen . | |
| 4,752,144 | 6/1988 | Wienen et al. | 417/420 |
| 4,869,654 | 9/1989 | Klaus | 417/420 |
| 4,952,429 | 8/1990 | Schmitz et al. | 417/420 |
| 5,108,715 | 4/1992 | Jekat et al. | 277/212 |

FOREIGN PATENT DOCUMENTS

| | | | |
|---|---|---|---|
| 0699909 | 12/1964 | Canada | 277/15 |
| 0344532 | 6/1989 | European Pat. Off. | 417/420 |
| 0499504 | 8/1992 | European Pat. Off. | 417/420 |
| 762483 | 4/1934 | France . | |
| 1166228 | 11/1958 | France | 415/168.2 |
| 1197413 | 12/1959 | France . | |
| 0035292 | 3/1983 | Japan | 415/174.2 |
| 380283 | 9/1964 | Switzerland . | |

OTHER PUBLICATIONS

M. Knorr et al., "Permanent Magnet Drives for Pumps and Agitators", 2314 World Pumps, Apr. 1982, No. 4, East Molesey, Surrey, Great-Britain.

*Primary Examiner*—Edward K. Look
*Assistant Examiner*—Christopher Verdier
*Attorney, Agent, or Firm*—Bell, Seltzer, Park & Gibson

[57] ABSTRACT

A compressor or turbine type rotary machine for compressing or expanding a dangerous gas, e.g. a gas that is toxic or explosive, comprises a closed enclosure formed outside the stator around a shaft passage receiving the shaft of the rotor, the enclosure being delimited by a bell and being filled with a liquid under pressure, a wet type mechanical seal being disposed between the rotor shaft and the stator, inside the stator. The liquid contained in the enclosure is put under pressure, and a magnetic coupling is provided to link the rotor shaft to an outside shaft. The invention makes it possible to prevent any leakage of dangerous gas from the inside to the outside of the rotary machine.

13 Claims, 1 Drawing Sheet

COMPRESSOR OR TURBINE TYPE ROTARY MACHINE FOR COMPRESSING OR EXPANDING A DANGEROUS GAS

BACKGROUND OF THE INVENTION

The invention relates to a compressor or turbine type rotary machine for compressing or expanding a dangerous gas, e.g. a gas that is toxic or explosive.

Such machines are used, in particular, in chemical industries for treating natural gas, etc. . . . .

As is well known in the art, a compressor or a turbine comprises a stator in which an annular gas flow chamber is formed, a rotor mounted to rotate in said chamber, a rotary shaft on which the rotor is fixed and which extends outside the stator through a shaft passage thereof, and bearings for guiding and supporting the shaft, which bearings are mounted in the shaft passage of the stator.

Outside the stator, the rotor shaft is connected to another shaft which is a driving shaft for a compressor or which is a driven shaft for a turbine.

When such a machine is used for treating a dangerous gas, it is essential to provide gas-tight sealing and to maintain it over time, specifically for preventing gases leaking to the outside as may happen along the shaft of the rotor.

A specific object of the invention is to solve this problem in a manner that is simple, effective, and cheap.

SUMMARY OF THE INVENTION

To this end, the invention provides a rotary machine of the above-specified type for compressing or expanding a dangerous gas, e.g. a gas which is toxic or explosive, the machine being characterized in that it includes a bell mounted in sealed manner on the outside of the stator around said shaft passage and delimiting a closed enclosure filled with liquid, means for pressurizing the liquid inside the enclosure to a pressure that is at least equal to or is slightly greater than the maximum pressure of the gas in the annular chamber of the stator, liquid-tight sealing means disposed in said shaft passage between the rotor shaft and the stator at the annular gas flow chamber end thereof and allowing only a very small leakage flow rate of liquid towards the annular chamber of the stator, and means for linking the shaft of the rotor to a second shaft outside the stator, said means including a rotary magnetic coupling which may include permanent magnets some of which are carried by the rotor shaft inside said bell and others of which are carried by the second shaft outside the bell.

The invention thus makes it possible to ensure the desired sealing around the shaft of the rotor where it passes through the stator by opposing leaks of gas under pressure that could occur along the shaft with a higher pressure of liquid existing outside the stator and inside a sealed enclosure surrounding the shaft passage. The low leakage rate of liquid that is allowed between the shaft passage and the annular gas flow chamber in the stator prevents the liquid sealing means provided in the shaft passage wearing rapidly and guarantees their length of life. In addition, the magnetic coupling transmits torque between the rotor shaft and the shaft outside the stator without piercing the bell delimiting the liquid-filled sealed chamber.

According to another characteristic of the invention, the annular chamber of the stator includes means for recovering the above-mentioned liquid leakage flow.

This prevents the gases leaving the machine of the invention containing traces of the liquid.

According to another characteristic of the invention, said liquid sealing means comprise a wet mechanical seal of the type comprising an annular piece having a hard surface, which piece is secured to the rotor shaft and is pressed against a complementary piece secured to the stator.

Such sealing means are relatively cheap and can be used with good efficiency up to speeds of rotation of the order of 3000 revolutions per minute (rpm) to 3500 rpm.

According to yet another characteristic of the invention, the rotor is constituted by at least one peripheral turbine wheel or peripheral compressor wheel.

Peripheral turbines and compressors are well known in the art for their high efficiency at medium speeds of rotation, of the order of 3000 rpm.

Since magnetic couplings also have the characteristic of providing good transmission up to maximum speeds of rotation of the order of 3000 rpm to 4000 rpm, it can be seen that the machine of the invention is remarkably homogeneous, with its essential components (the magnetic coupling, the wet mechanical seal, and the peripheral turbine or compressor wheel) having optimum operating speeds that are of the same order.

According to another characteristic of the invention, the liquid pressurizing means comprise a pressure multiplier whose input is connected via a pressure outlet to the annular chamber of the stator and whose outlet is connected to the enclosure delimited by said bell.

This pressure multiplier may ba set to a ratio that is slightly greater than one (e.g. 1.1), thereby guaranteeing that the pressure of the liquid inside the bell is always slightly greater than the pressure of the gas inside the annular chamber of the stator, in spite of possible variations in said gas pressure.

Advantageously, the liquid pressurizing means form a portion of a liquid closed circuit including a circulation pump, a heat exchanger for cooling the liquid, and liquid passages opening out respectively to the inside of said bell and into the shaft passage through the stator.

This makes it possible, in particular, to maintain the temperature of the liquid to a relatively constant value.

According to yet another characteristic of the invention, the stator includes an intermediate chamber through which the rotor shaft passes, said intermediate chamber being formed between the annular gas flow chamber and the above-mentioned shaft passage, said intermediate chamber being delimited axially by dry seals carried by the rotor shaft, means being provided to bring a barrier gas under relatively high pressure into said annular chamber between said dry seals, and to bring a scavenging gas at relatively low pressure into an annular space formed around the rotor shaft between said intermediate chamber and the shaft passage.

This ensures liquid sealing for the machine of the invention and any mixing between the liquid and the gas flowing through the stator is avoided, even in the event of the wet mechanical seal failing.

BRIEF DESCRIPTION OF THE DRAWINGS

The invention will be better understood and other characteristics, details, and advantages thereof will appear more clearly on reading the following description given by way of example and made with reference to the accompanying drawing, in which.

DESCRIPTION OF THE ILLUSTRATED EMBODIMENTS

Figure 1:
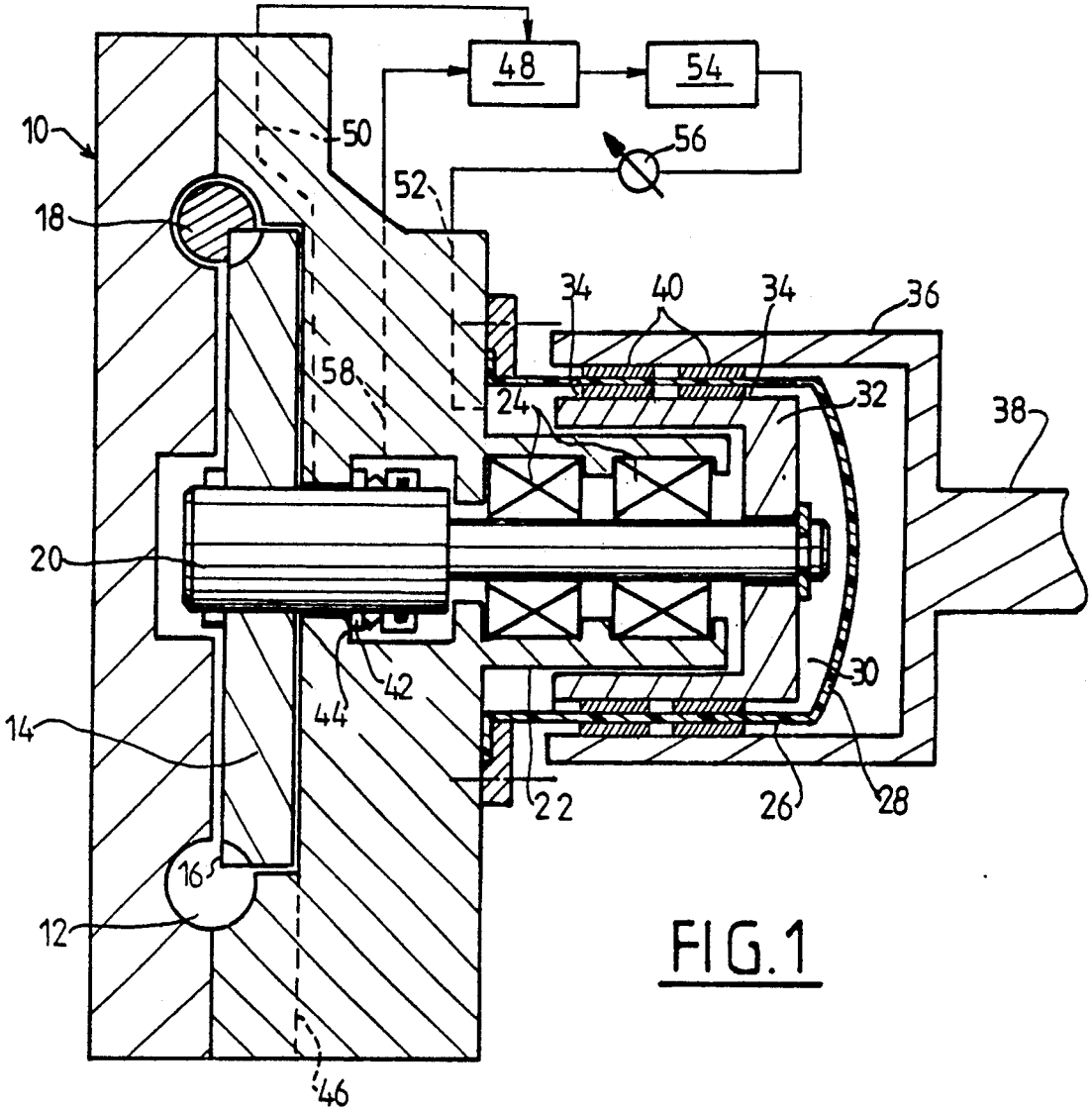
FIG. 1 is a diagrammatic axial section view through a machine of the invention.

The machine shown by way of example in FIG. 1 is a peripheral compressor for processing a flow of dangerous gas, e.g. a gas which is toxic or explosive.

In conventional manner, the compressor comprises a stator 10 having an annular gas flow cheer 12 formed therein. A rotor 14 constituted by a peripheral compressor wheel comprises blades 16 that rotate in the annular chamber 12 to impart speed and compression to the gas.

In conventional manner for a peripheral compressor, a shutter 18 is disposed in the annular chamber 12 between the outlet of a feed duct and the inlet of a gas outlet duct (not shown) both of which are formed through the stator.

The rotor 14 is mounted on one end of a rotary shaft 20 which passes through a shaft passage 22 presented by the stator and which is supported and guided in said shaft passage by bearings 24.

A bell 26 which is cylindrical in shape with a bulging end is fixed in sealed manner via its base to the stator, on the outside of the stator and around the shaft passage 22 so as to delimit a sealed enclosure 30 in which the shaft passage 22, the end of the shaft 20 that projects from said shaft passage, and an annular part 32 secured to the shaft 20 and carrying permanent magnets 34 on its outer peripheral surface are all housed, which magnets are in the immediate vicinity of the cylindrical wall of the bell 26.

The annular piece 32 and its permanent magnets 34 form part of a magnetic coupling which also includes, outside the bell 26, an annular piece 36 which is secured to a drive shaft 38 which is coaxial with the shaft 20 of the rotor, permanent magnets 40 being provided on the inside peripheral surface of the piece 36 and being disposed to correspond with the above-mentioned magnets 34, while being separated therefrom by the cylindrical wall of the bell 26.

The bell 26 may be made of a metal alloy such as that sold under the name Hastelloy, which alloy is preferably non-magnetic and non-conductive, and it may also be made of a composite material, e.g. based on carbon fibers, to eliminate eddy currents in the magnetic coupling.

The sealed enclosure 30 delimited by the bell 26 is designed to be filled with a liquid under pressure, one of whose functions is to lubricate the bearings 24. This liquid may therefore be an oil when the bearings 24 are ball bearings, or it may be water when hydrodynamic bearings 24 are used, or it may be any other appropriate liquid.

At the end of the shaft passage 22 situated adjacent to the gas circulation annular chamber 12, liquid sealing means are disposed between the shaft 20 and the stator. As shown highly diagrammatically in FIG. 1, these sealing means comprise a wet mechanical seal, including an annular piece 42 mounted in sealed manner on the shaft 20 and driven in rotation thereby, said annular piece 22 having a hard radial surface pressed against a radial surface of a corresponding piece 44 of the stator. This type of seal allows the liquid to leak at a very low rate into the annular chamber 12 of the stator when the pressure of the liquid is greater than the pressure of the gases inside the stator. Means may optionally be provided inside the stator and along the rotor for recovering this leakage flow of liquid, as shown at 46, assuming that it is desired to reduce the traces of liquid present in the treated gas.

The liquid pressure inside the enclosure 30 is regulated by pressurizing means comprising, in the example shown, a pressure multiplier 48 having one inlet connected to a pressure outlet 50 situated immediately downstream from the wet mechanical seal 42, 44, and whose outlet is connected to a duct 52 passing through the stator and opening out inside the bell 26. The pressure multiplier 48 is preferably part of a closed liquid circuit that includes a heat exchanger 54 mounted at the outlet from the pressure multiplier, and a magnetically driven sealed circulation pump 56.

The liquid inlet to the pressure multiplier 48 is connected to a duct 58 that opens out into the shaft passage 22 upstream from the wet mechanical seal 42.

The operation of this compressor is clear from the above.

The drive shaft 38 rotates the shaft 20 of the rotor about its axis and transmits driving torque thereto via the magnetic coupling constituted by the pieces 32 and 36 and by the permanent magnets 34 and 40. When rotated, the shaft 20 causes the blades 16 of the rotor to rotate inside the annular chamber 12 of the stator, thereby imparting speed and compression to the gas inside said chamber. The gas pressure applied to the pressure multiplier 48 sets a liquid pressure inside the bell 26 which is slightly greater than the gas pressure. This greater pressure of the liquid opposes any penetration of the gas into the shaft passage 22 and causes a very small flow rate of liquid to leak through the wet mechanical seal 42 towards the annular chamber 12, with said leakage rate being, for example, of the order of 0.5 $cm^3$ to 1 $cm^3$ per hour. This leakage flow may optionally be recovered at 46 before it penetrates into the gas flow annular chamber 12.

The maximum speeds of rotation of the magnetic coupling, of the wet mechanical seal 42, and of the peripheral compressor wheel are well suited to one another (being about 3000 rpm to 4000 rpm at most), thereby guaranteeing optimum overall operation.

The heat exchanger 54 makes it possible to keep the liquid inside the enclosure 30 at a temperature of about 50° C. to 60° C., at most. The pressure of the liquid is 20 bars, for example, while the pressure of the gas is about 18 bars inside the annular enclosure 12.

Figure 2:
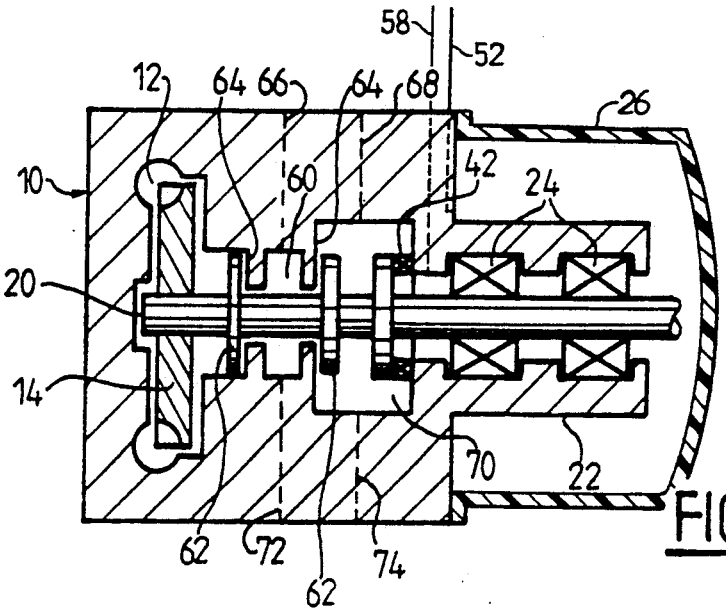
FIG. 2 is a diagrammatic fragmentary axial section view on a smaller scale through a variant embodiment of the machine.

A variant embodiment of the compressor is shown in part in FIG. 2.

The compressor of FIG. 2 includes the same components as that of FIG. 1, i.e. a stator 10 having an annular gas flow chamber 12 in which there rotates a rotor 14 constituted by a peripheral compressor wheel and mounted on a shaft 20 which is guided and supported by bearings 24 housed in a shaft passage 22 formed through the stator. As in the previous embodiment, the shaft passage 22 is surrounded on the outside by a bell (not shown) delimiting a sealed enclosure which is filled with a fluid under pressure, and by a magnetic coupling (not shown) enabling driving torque to be transmitted to the shaft 20. A wet mechanical seal 42 similar to that shown in FIG. 1 is provided between the shaft 20 and the stator, at the end of the shaft passage 22 directed towards the annular chamber 12.

In this variant embodiment, an intermediate chamber 60 is formed in the stator 10 between said end of the shaft passage 22 and the annular gas flow chamber 12. This intermediate chamber 60 is delimited axially by dry seals 62 carried by the shaft 20 and co-operating with corresponding radial surfaces 64 of the stator 10. A duct 66 formed through the stator 10 enables a barrier gas at a relatively high pressure (greater than the pressure of the gas in the annular chamber 12) to be fed into said intermediate chamber 12, said barrier gas being compatible with the gas flowing through the stator and optionally itself being a dangerous gas.

Furthermore, another duct 68 formed through the stator 10 serves to bring a scavenging gas under relatively low pressure into the annular space 70 formed inside the stator around the shafts 20 between the intermediate chamber 60 and the corresponding end of the shaft passage 22 at which the wet mechanical seal 42 is located.

The intermediate chamber 60 and said annular space 70 are connected to the outside of the stator by respective gas outlet ducts 72 and 74.

These outlet ducts 72 and 74 are connected to gas take-up means, e.g. they lead to combustion means such as a surplus gas burner or the like.

In operation, the barrier gas under relatively high pressure which is brought into the intermediate chamber 60 via the duct 66 may leak from one side into the annular gas flow chamber 12 and from the other side into the annular space 70 surrounding the end of the shaft passage 22 and the wet mechanical seal 42. The scavenging gas brought into this annular space 70 by the duct 68 makes it possible to evacuate via the outlet duct 74 the leakage flow of barrier gas and the leakage flow of liquid reaching said annular space 70. The gases leaving the intermediate chamber 60 via the duct 72 and the annular space 70 via the duct 74 may, for example, subsequently be delivered to a burner or to any other appropriate combustion means.

In this variant embodiment as shown in FIG. 2, a failure of the wet mechanical seal 42 has no effect on the operation of the compressor, with the barrier gas supplied to the intermediate chamber 60 preventing any flow of liquid into the annular gas flow chamber 12.

The barrier gas outlet 72 may be omitted, with the barrier gas then escaping on one side to the annular chamber 12 and on the other side to the annular space 70.

We claim:

1. A rotary machine for treating a gas under pressure, said machine comprising a stator in which an annular gas flow chamber is formed, a rotor mounted to rotate in said chamber, a rotary shaft on which the rotor is fixed and which extends outside the stator through a shaft passage thereof, bearings for guiding and supporting the shaft being mounted in said shaft passage of the stator, a bell mounted in sealed manner on the outside of the stator around said shaft passage and delimiting a closed enclosure filled with liquid and separate from said annular gas flow chamber, means for pressurizing the liquid inside the enclosure to a pressure not lower than a maximum value of the gas pressure in the annular chamber of the stator, said liquid pressurizing means comprising a pressure multiplier whose input is connected via a pressure outlet to the annular gas flow chamber of said stator and whose outlet is connected to the closed liquid filled enclosure delimited by said bell, liquid-tight sealing means disposed in said shaft passage between the rotor shaft and the stator at the annular gas flow chamber end thereof and allowing only a very small leakage flow rate of said pressurized liquid towards the annular chamber while inhibiting the admission of gas from said annular chamber past the sealing means, and link means comprising a rotary magnetic coupling for linking the rotor shaft to a second shaft outside the stator.

2. A machine according to claim 1, wherein the magnetic coupling uses permanent magnets some of which are carried by the rotor shaft inside said bell and others of which are carried by the second shaft outside the bell.

3. A machine according to claim 1, wherein the stator includes duct means for recovering the liquid leakage flow.

4. A machine according to claim 1, wherein said liquid sealing means comprise a wet mechanical seal comprising an annular piece having a hard surface, which piece is secured to the rotor shaft and is pressed against a complementary piece secured to the stator.

5. A machine according to claim 1, wherein the rotor includes at least one peripheral turbine wheel.

6. A machine according to claim 1, having a speed of rotation limited to a maximum value between 3000 rpm and 3500 rpm.

7. A machine according to claim 1, wherein said bell is made of a non-magnetic and non-conductive alloy.

8. A machine according to claim 1, wherein the liquid pressurizing means form a portion of a closed liquid circuit that includes a circulation pump, a heat exchanger for cooling the liquid, and liquid passages opening out respectively into the inside of said bell and into the shaft passage.

9. A machine according to claim 1, wherein the rotor includes at least one peripheral compressor wheel.

10. A machine according to claim 1, wherein said bell is made of a composite material based on carbon fibers.

11. A rotary machine for treating a gas under pressure, said machine comprising a stator in which an annular gas flow chamber is formed, a rotor mounted to rotate in said chamber, a rotary shaft extending outside the stator through a shaft passage thereof, bearings for guiding and supporting the shaft in said shaft passage, a bell mounted in sealed manner on the outside of the stator around said shaft passage and delimiting a closed enclosure filled with liquid and separate from said annular gas flow chamber by an intermediate chamber through which the rotor shaft passes, said intermediate chamber being formed between the annular gas flow chamber and the shaft passage and being delimited axially by dry seals carried by the rotor shaft, means provided to bring a barrier gas under relatively high pressure into said intermediate chamber between said dry seals, and to bring a scavenging gas at relatively low pressure into an annular space formed around the rotor shaft between said intermediate chamber and the shaft passage, the machine further comprising means for pressurizing the liquid inside the enclosure to a pressure not lower than a maximum value of the gas pressure in said annular gas flow chamber, liquid-tight sealing means disposed in said shaft passage between the rotor shaft and the stator at the annular space end thereof and allowing only a very small leakage flow rate of said pressurized liquid towards the annular space while inhibiting the admission of gas from said annular space past the liquid-tight sealing means, and link means comprising a rotary magnetic coupling for linking the rotor shaft to a second shaft outside the stator.

12. A machine according to claim 11, wherein the intermediate chamber is connected to a gas outlet duct.

13. A machine according to claim 11, wherein said annular space is connected to a gas outlet duct.

* * * * *